United States Patent [19]

Toimil

[11] 4,267,926

[45] May 19, 1981

[54] BOX FOR SMOKING ARTICLES IN THE FORM OF CIGARETTES OR THE LIKE

[75] Inventor: Ramon Toimil, Bole, Switzerland

[73] Assignee: Fabriques de Tabac Reunies S.A., Neuchatel, Switzerland

[21] Appl. No.: 59,097

[22] Filed: Jul. 19, 1979

[30] Foreign Application Priority Data

Jul. 27, 1978 [LU] Luxembourg ..... 80049

[51] Int. Cl.[3] ..... B65D 85/10; A24F 15/00; B65D 5/38; B65D 5/66

[52] U.S. Cl. ..... 206/268; 206/270; 229/20; 229/44 CB

[58] Field of Search ..... 206/268, 271, 273; 229/9, 19, 20, 10, 11

[56] References Cited

U.S. PATENT DOCUMENTS

| | | | |
|---|---|---|---|
| 3,048,320 | 8/1962 | Houland et al. | 229/20 |
| 3,773,247 | 11/1973 | Mueller | 229/44 CB |
| 3,933,299 | 1/1976 | Shimada et al. | 229/20 |
| 3,977,520 | 8/1976 | Grimm | 229/19 |

*Primary Examiner*—William T. Dixson, Jr.

[57] ABSTRACT

A box having inner and outer components made from individual cut blanks, the inner component including an integral tongue member arranged to form a loop which functions to actuate a folding lid.

8 Claims, 11 Drawing Figures

BOX FOR SMOKING ARTICLES IN THE FORM OF CIGARETTES OR THE LIKE

TECHNICAL FIELD

The invention concerns a box for cigarettes or the like, including a four-walled outer box, open on top and bottom, made from a first cut blank of stiff cardboard, into which an inner box can be inserted, made from a second blank of stiff cardboard, whose upper part is made as a folding (top) by means of incisions on both sidewalls and a fold on the back wall, joining these; the back wall of the inner box having an integral tongue member which is attached to the outer box by its free lower end, and which moves the folding lid backward when the inner box is lifted upward.

BACKGROUND ART

In the case of a box, whose German patent number is No. 613 158, of a similar kind, the tongue is placed into a slit of the outer box by its free end, inside which it can move until, when the inner box is lifted upward, it is stopped by an enlargement of its free end which does not fit through the slits; as the inner box is pushed further upward, it opens the folding lid. This arrangement of mounting the tongue to the outer box is difficult to carry out in practice because, at the time of assembly of the box, the tongue can be placed into the slit only with difficulty and by bending it. This cannot be done on modern packaging equipment without considerable expense.

In German Pat. No. 1 536 280 there is shown a box whose folding lid can be lifted; the lower end of a tongue is bent upward into a hook, which, when the inner box is lifted upward, grabs hold of a counterhook which is created by bending the upper border of the outer box. In order for the two hooks to get hold of each other, they have to be much thicker and otherwise dimensioned to perform the necessary functions. This arrangement tends to cause buckling of the upper rim of the back wall.

In U.S. Pat. No. 2,990,994 there is shown a box with a folding lid which can be opened; its inner and outer box consists of one cardboard cutting only. For the back wall of the outer box two cardboard layers are provided; the inner one joins at the top with the folding lid of the inner box, the outer one joins below in a fold with the inner one. In the area of the fold the outer cardboard layer of the back wall is flexible. If the inner box is pushed upward, the flexible area is first pulled through on the inside, then the folding lid is raised. Due to the double cardboard layer of the back wall additional cardboard is needed which makes the box unnecessarily thick. Also, the flexible area which is visible from the outside makes this box unattractive.

In a further development of this box, as shown in U.S. Pat. No. 3,977,520, the flexible area has been covered on the outside by an additional third cardboard layer for the back wall of the outer box. This means an even larger amount of cardboard and increased thickness of the package.

DISCLOSURE OF INVENTION

It is an object of the invention to provide a box as initially described in such a way that it can be manufactured easily from two blanks of modern packaging machines and still function effectively. Also, the mechanism for the opening of the lid should be achieved, if possible, with the minimum quantity of material, and without compromising either the wall-thickness used or the outward appearance of the box.

In accordance with the present invention the free end of the tongue is glued to the outer box and the tongue has a flexible area which, when the inner box is inserted, forms a loop; this loop is pulled up as the inner box is pushed upward.

At the time of production of the blank for the inner box, the tongue can be punched out and the area for the loop can be made flexible, preferably by means of several close folds which lie parallel to each other and parallel to the fold of the lid. At the time of folding and assembling the box the free end of the tongue is bent in a U shape and glued to an opposed interior surface of the outer box. On modern packaging machines the box is then folded around the contents, for examplea group of cigarettes, so that at the time of gluing the cigarettes serve as support should this be necessary.

In the area of the tongue loop there are three layers of material, two forming the loop and one forming the outer box, and there is sufficient flexibility of the loop so that no additional function-related space is required. For this reason if none other, the back wall is far less buckled, if at all, compared with the second technique mentioned above. Without limiting the desired function, it is possible to place the thicker area far from the upper rim of the outer box with a correspondingly long tongue, so that the rim warps as little as possible, if at all, which is a particular advantage because any warping in the rim-area would be unattractive.

The invention will be explained in more detail with respect to the enclosed drawings.

BEST MODE FOR CARRYING OUT THE INVENTION

Figure 1:
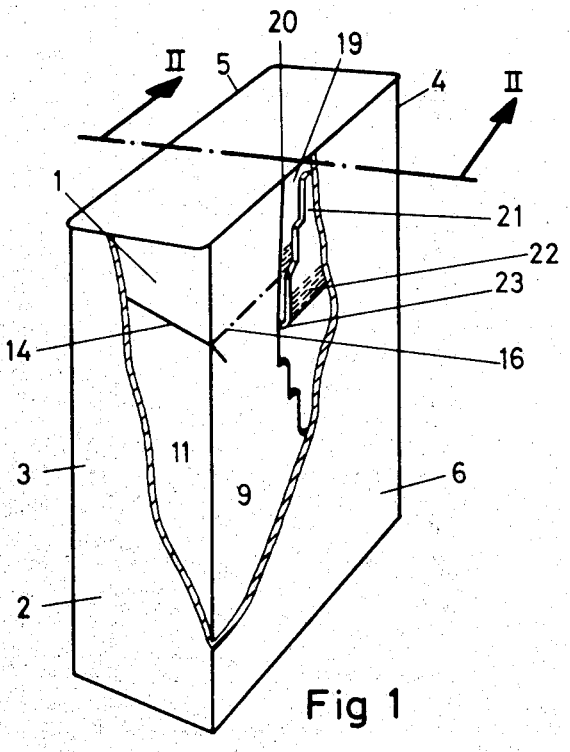
FIG. 1 a first embodiment of a box according to the invention, closed, with part of the box broken open to show internal details, FIG. 2 Section II of FIG. 1, FIG. 3 a section, as in FIG. 2, of the same box, with the inner box pulled out far enough so that the loop is pulled straight, but the lid has not yet tipped, FIG. 4 the box shown in the same section as in FIG. 2, but with tipped lid, FIG. 5 cut blank for the outer box of FIGS. 1 to 4, FIG. 6 cut blank for the inner box of FIGS. 1 to 4, FIG. 7 the inner box as per FIG. 2, seen from the side indicated by arrow VII in FIG. 2, FIG. 8 the inner box of a second embodiment, in the manner of FIG. 7, FIG. 9 the inner box of a third embodiment, in the manner of FIG. 7, FIG. 10 section X of FIG. 9, the tongue being bent upward and backward.

According to FIGS. 1 to 7, the inner box is generally marked as 1, the outer box as 2. The outer box 2 consists of the two lateral walls 3, 4 as well as the front wall 5 and the back wall 6, and is open on top and at the bottom. Into this outer box 2 the inner box 1 is inserted. The inner box consists of the front wall 8, the back wall 9, the two lateral walls 10, 11, the roofwall 12 and the floor 13. The upper part of the inner box forms, through two incisions 14 and 15 in the side walls 11, 10 and through a fold 16 which joins these incisions along the back wall 9, a lid 17 which can be folded backward.

Figure 2:
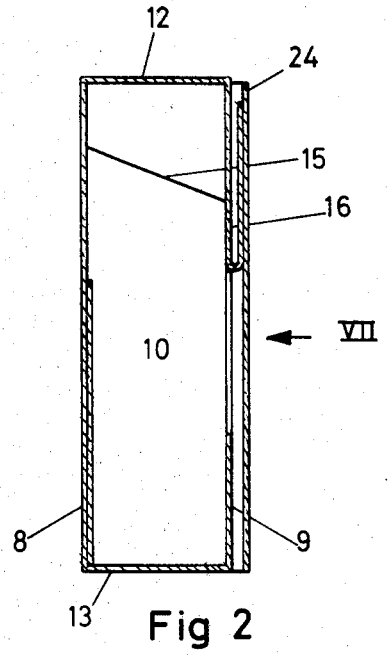
Figure 3:
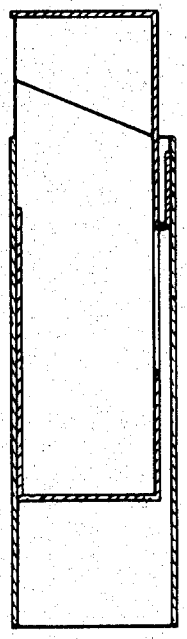
Figure 4:
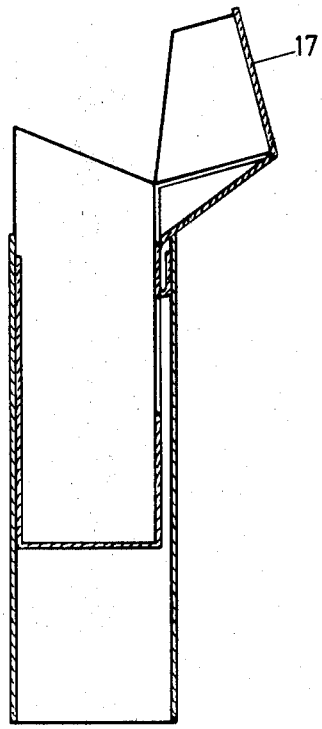
Figure 5:
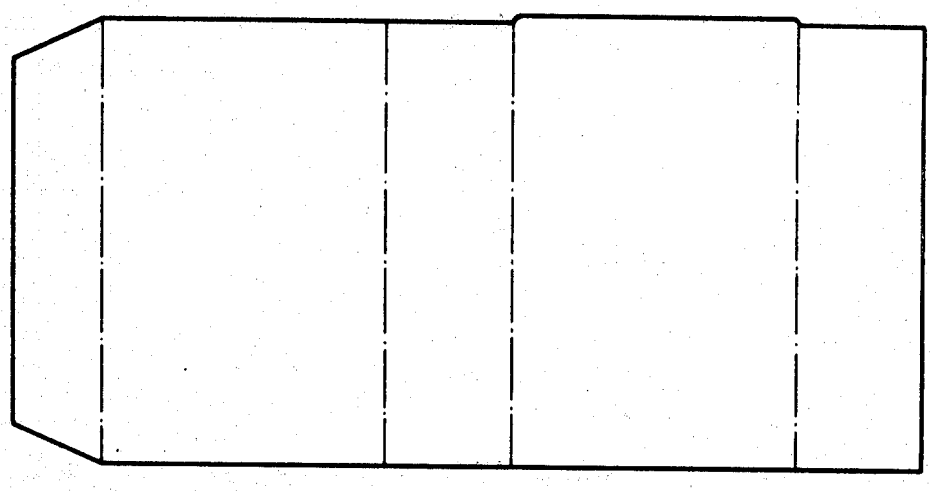
Figure 6:
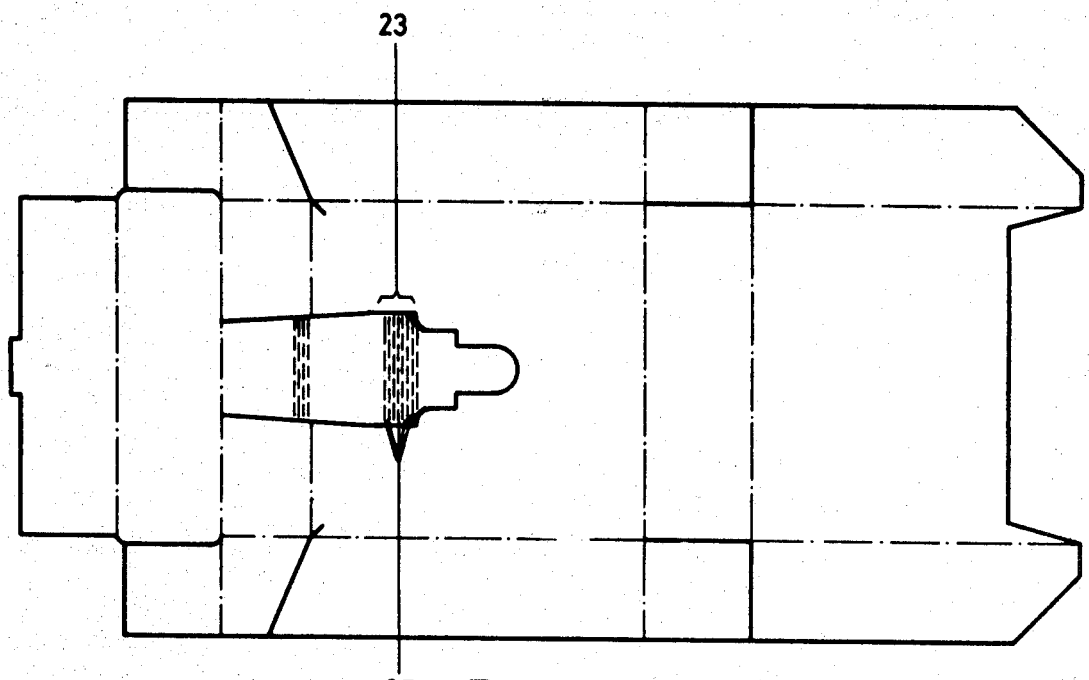
Figure 7:
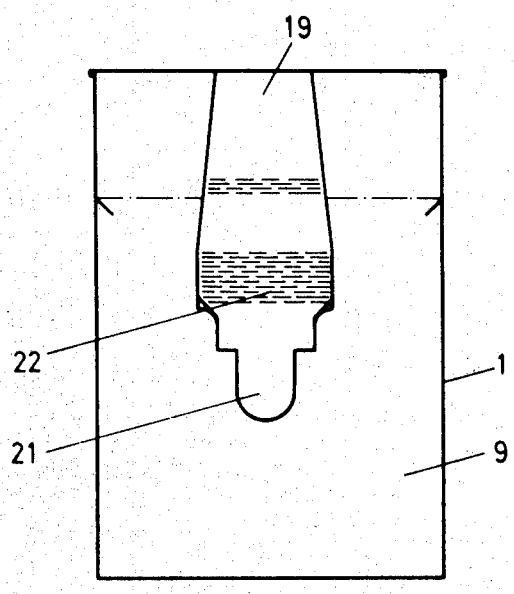

A tongue 19 is punched out of the back wall 9, except where it is attached along the upper rim 20 of the back wall to the lid. The tongue 19, as shown in FIG. 7, has an area of adhesion 21 on its free lower end, see also FIG. 1, on the side which someone viewing FIG. 7 cannot see. Immediately adjacent to this area of adhesion is a flexible area 22. The free end of the tongue, as visible in FIG. 1, is turned upward and backward in a U-shape, so that a loop 23 results, which is formed through the flexible area 22. The area 22 is made flexible by means of score lines 25, which run parallel to each other and parallel to fold 16; they are arranged closely together across the whole flexible area, see FIG. 6. In the area of adhesion 21, the free end of the tongue, in the assembled box, is glued to the inside of the opposite part of the back wall 6 to the outer box. The tongue is so long, or rather the glue is placed so high that, when the box is closed, loop 23 results, which has reached its full extension, see FIG. 3, when the inner box is pushed out to the point where the fold arrives just as the height of the upper rim 24 of the outer box 2. At that point the tongue is straight; if the inner box is pushed even higher than its position in FIG. 2, then the tongue cannot follow and pulls the lid backward into the position shown in FIG. 4. In order to close it, the lid is brought back by hand, and the inner box is pushed back into the outer box, with the resulting loop 23 as shown in FIGS. 1 and 2.

Figure 8:
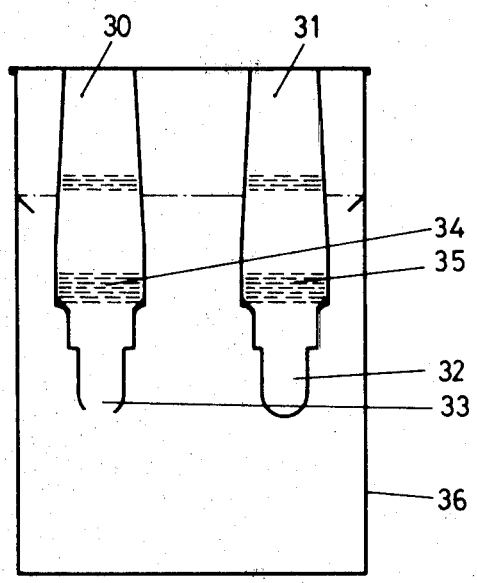

The embodiment shown in FIG. 8 is different from that of FIGS. 1 to 7 only in that on the inner box 36 two tongues 30 and 31 are provided, which have at their free lower end an area of adhesion 32 or 33 respectively and a flexible area 34 and 35 respectively. Each of these tongues 30 and 31 per se is made exactly like tongue 19 and also equally glued with a loop. The two tongues lying side by side share the traction, which acts on the lid and on the back wall of the outer box; they contribute to minimizing buckling of the back wall of the outer box.

Figure 9:
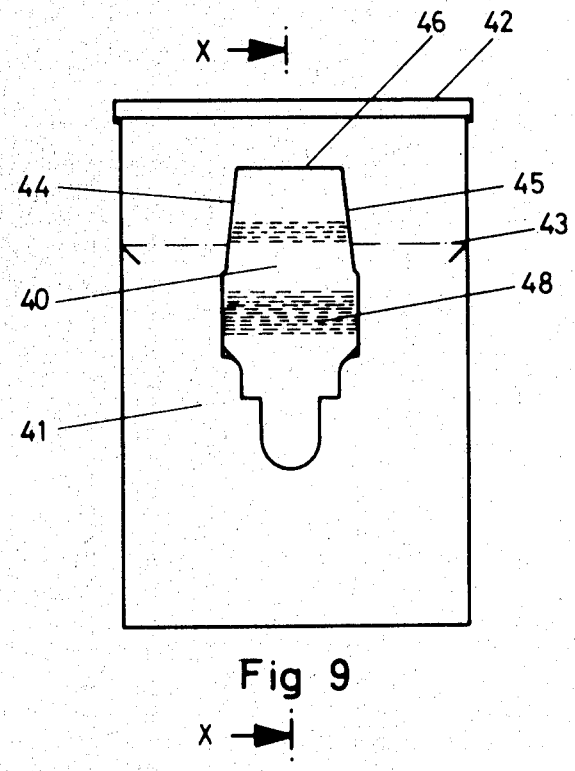
Figure 10:
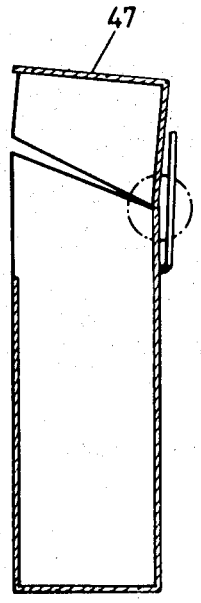
Figure 11:
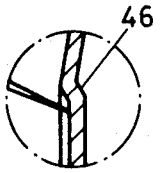
FIG. 11 the dotted area of FIG. 10 enlarged.

The embodiment shown in FIG. 9 is different from that shown in FIGS. 1 to 7 only in that the tongue 40 does not reach up to the upper rim of the back wall 41, but only up to approximately midway between the upper rim 42 and the fold 43 for lid 47. Punch-cuts 44 and 45 for the tongues are placed to terminate above fold 43 and below rim 42. This fold 46 has a step directed outward which, as shown in FIG. 11, has approximately the thickness of the material used as cardboard. This favors the swinging back of the lid when it is pulled open. The uppermost end of the incisions cannot be seen in this embodiment, with the pack closed, so that also the step resulting from fold 46 can hardly be seen in the picture of the closed box. The tongue 40 is enlarged in width across the flexible area 48.

All of these embodiments are made of two blanks of stiff cardboard each.

For production, the two blanks are first punched out; the tongue is punched out at the same time and the flexible area is achieved by scoring or indenting. Next the inner box with the flexible area is folded and filled. Then the outer box is folded around the closed, filler inner box, after the area of adhesion has first been covered with glue.

The glue can then be pressed upon from outside, since it can brace itself on the inside filling. A cold, hardening glue can be used, but a thermoplastic glue is also possible which has to be briefly activated by a heated stamp applied from the outside.

This type of production, with a few modifications, easily fits in with the usual production of filled, folding boxes in two parts; it is possible, without much trouble, to change packaging machines for folding boxes in two parts without raising of the lid over for production of folding boxes according to the invention. For this reason the above described method of production is preferred, even though the invention is not limited to that method.

I claim:

1. Box for smoking articles in the form of cigarettes or the like, comprising a four-walled outer box, open on top and on the bottom, made from a first blank of stiff cardboard, and into which an inner box is inserted, the inner box being made from a second blank of stiff cardboard, having opposed side walls and a back wall whose upper part provides a folding lid (top) formed by means of inclusions on both side walls and a fold on the back wall joining these, and a tongue punched from the back wall of the inner box, said tongue being attached to the outer box by its free lower end so that it moves the folding lid backward when the inner box is lifted upward, said box being further characterized in that the free end of the tongue (19) is glued to the outer box (2) and the tongue (19) has a flexible area (22) which, when the inner box (1) is inserted forms a loop (23) which is opened when the inner box is pushed upward.

2. Box according to claim 1, wherein the loop (23) is bent upward and backward in a U shape.

3. Box according to claim 2, wherein the area of the tongue (19) forming the loop (23) has been rendered flexible by several closely spaced score lines which are arranged parallel to each other and parallel to the fold (43) of the folding lid (17).

4. Box according to claim 2, wherein the laterally spaced inclusions defining the tongue (19) reach to the upper end of the back wall (9).

5. Box according to claim 1, including laterally spaced tongues (30, 31) arranged along the width of the back wall (36) of the inner box, each of these tongues (30, 31) being glued to the outer box, thus forming two separate loops.

6. Box according to claim 1, wherein the laterally spaced incisions (44, 45) defining the tongue extend above the fold (43) for the lid, but terminate below the upper rim (42) of the back wall (41), and a fold (46) is provided which runs between the ends of the incisions (44, 45) parallel to the fold (43) of the lid.

7. Box according to claim 6, wherein the fold (46) for the tongue forms a step (FIG. 11) jutting outward from the back side, roughly a thickness of the cardboard.

8. Box according to claim 1, wherein the tongue (19 or 40) is enlarged across the flexible area (22 or 48).

* * * * *